US007137350B2

(12) United States Patent
Waldock

(10) Patent No.: US 7,137,350 B2
(45) Date of Patent: Nov. 21, 2006

(54) CATAMARAN WITH EXTENDING PLATFORM CARRIED BY THE UNDERWING AND AN EXTENDING DEPLOYABLE RAMP CARRIED BY THE EXTENDING PLATFORM

(76) Inventor: William L. Waldock, 117 E. Washington Row, Sandusky, OH (US) 44870

( * ) Notice: Subject to any disclaimer, the term of this patent is extended or adjusted under 35 U.S.C. 154(b) by 0 days.

(21) Appl. No.: 11/151,120

(22) Filed: Jun. 13, 2005

(65) Prior Publication Data

US 2006/0081169 A1 Apr. 20, 2006

Related U.S. Application Data

(63) Continuation-in-part of application No. 10/850,999, filed on May 21, 2004.

(51) Int. Cl.
*B63B 17/00* (2006.01)

(52) U.S. Cl. ..... 114/362; 114/219

(58) Field of Classification Search ..... 114/61.11, 114/219, 343, 362; 14/27
See application file for complete search history.

(56) References Cited

U.S. PATENT DOCUMENTS 3,808,998 A * 5/1974 Molotzak ..... 114/284
4,145,786 A * 3/1979 Myers ..... 14/27
4,664,053 A * 5/1987 Mesinger ..... 114/219
4,841,893 A * 6/1989 Ellison ..... 114/219
5,660,133 A * 8/1997 Munich ..... 114/219
5,809,923 A * 9/1998 Yilmaz ..... 114/61.11

* cited by examiner

*Primary Examiner*—Lars A. Olson
(74) *Attorney, Agent, or Firm*—Mueller and Smith, LPA

(57) ABSTRACT

A catamaran has a pair of spaced-apart pontoons, each having a forward tapered end and a rearward end. An underwing is affixed to the pontoons and spans therebetween. A platform is pivotally connected to the underwing forward end and/or rearward end and conforms to the pontoons at their forward tapered end or their rearward end, respectively. A power assembly is connected to the platform for lowering or raising the platform from a stowed position to a plurality of working positions—including positions below the waterline—of the catamaran and for raising or lowering the platform back to the stowed position. For protecting the craft from damage, the platform also can carry a deployable extending ramp formed from a pair of spaced-apart floating pontoons with a walkway extending between the floating pontoons. A novel fendering system for the craft also is disclosed.

19 Claims, 9 Drawing Sheets

FIG. 5
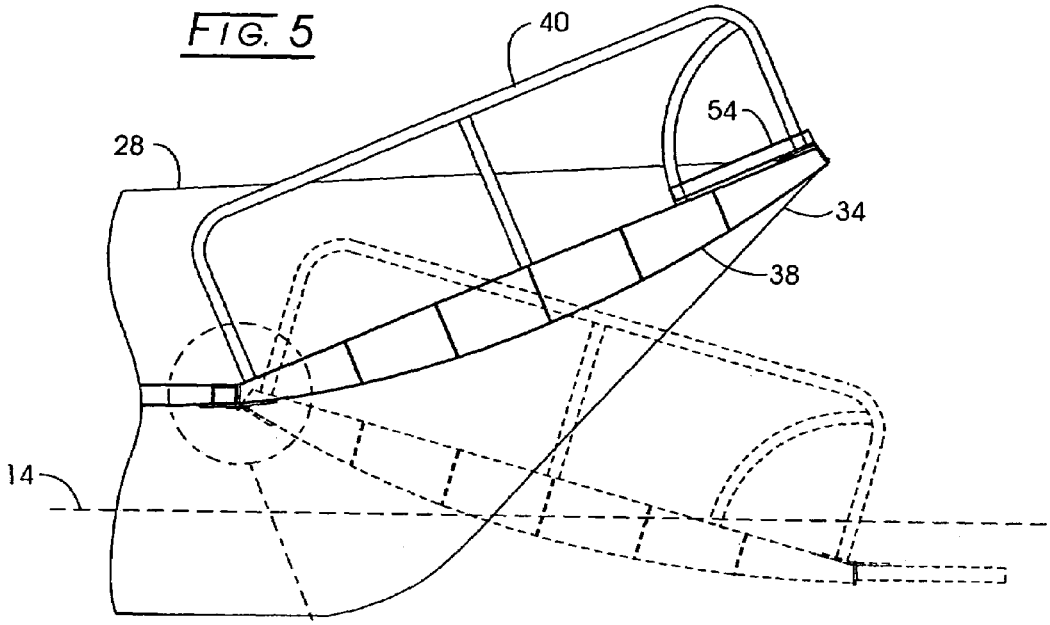
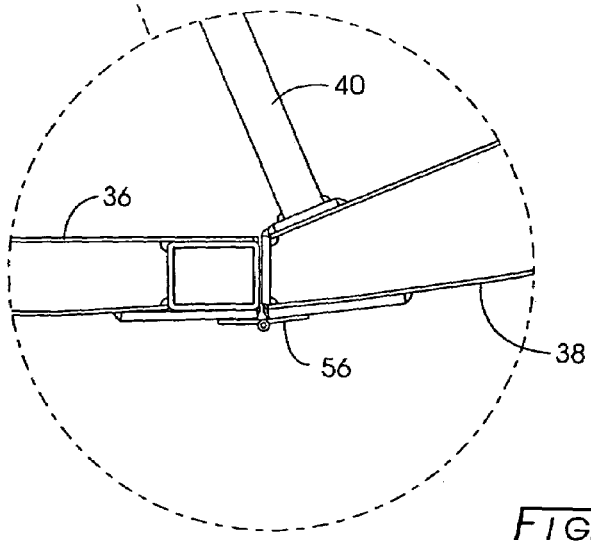
FIG. 6

FIG. 7
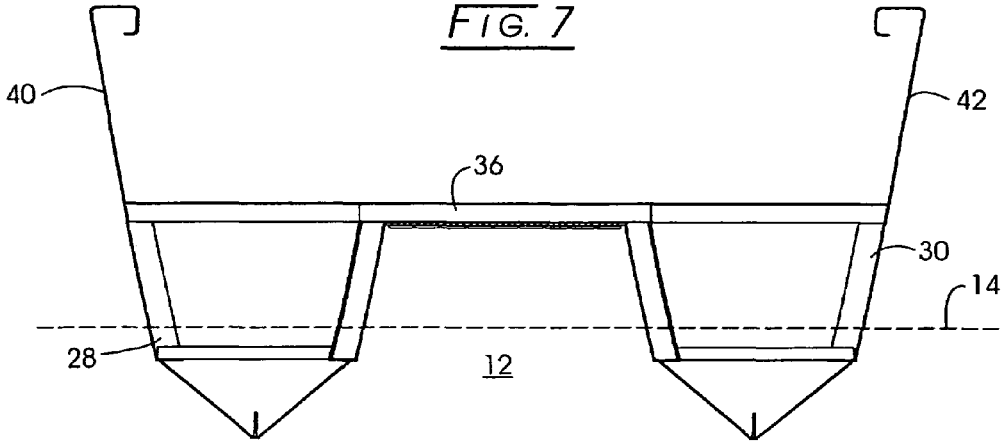
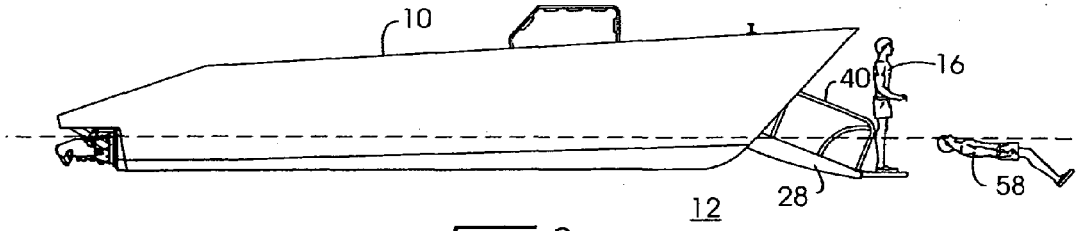
FIG. 8
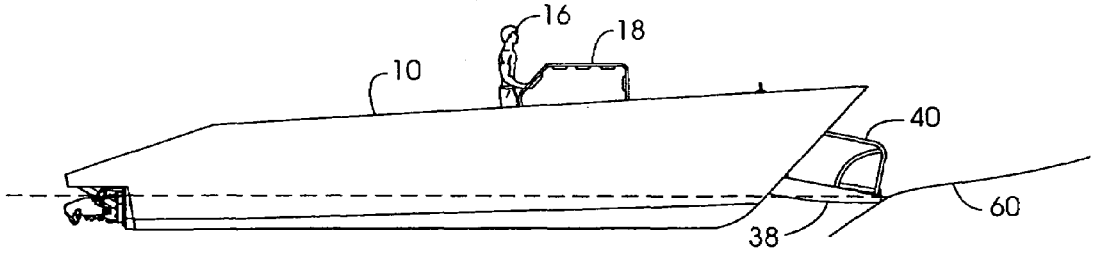
FIG. 9

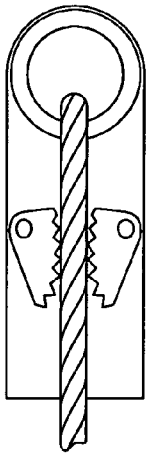
FIG. 29
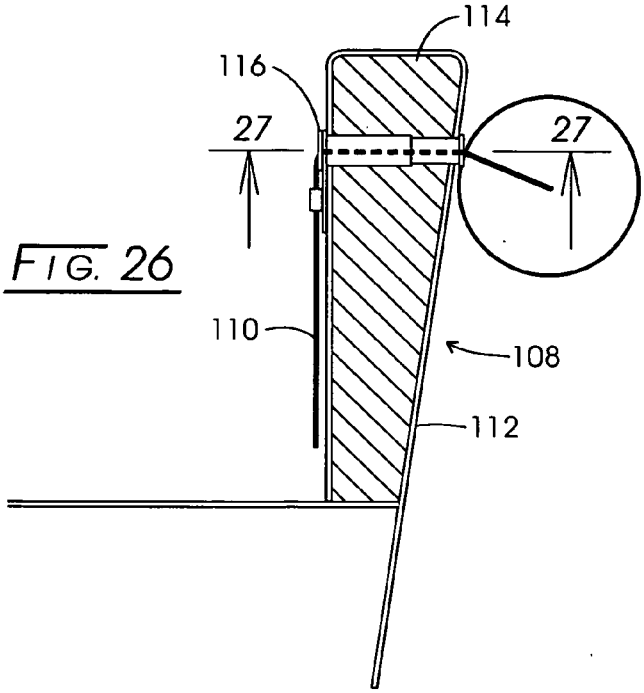
FIG. 26
FIG. 27
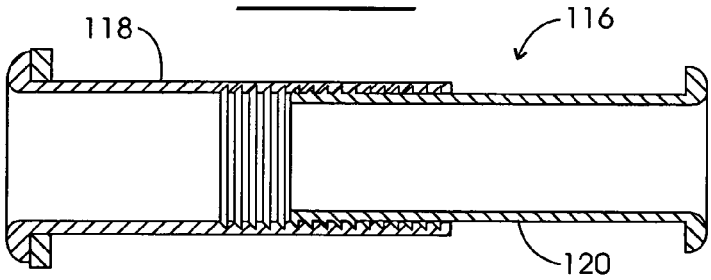
FIG. 28
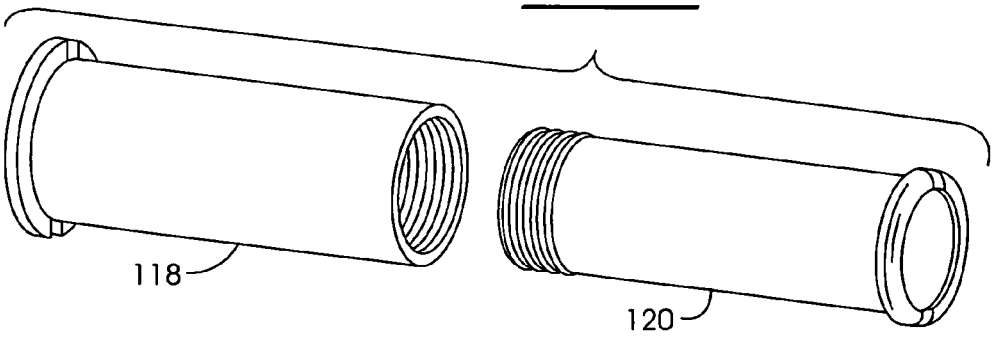

CATAMARAN WITH EXTENDING PLATFORM CARRIED BY THE UNDERWING AND AN EXTENDING DEPLOYABLE RAMP CARRIED BY THE EXTENDING PLATFORM

CROSS-REFERENCE TO RELATED APPLICATIONS

This application is a continuation-in-part of application Ser. No. 10/850,999, filed on May 21, 2004, the disclosure of which is expressly incorporated herein by reference.

STATEMENT REGARDING FEDERALLY SPONSORED RESEARCH

Not applicable.

BACKGROUND OF THE INVENTION

The present invention generally relates to watercraft and more particularly to a catamaran with a forward hinged underwing or bridgework lowerable at sea to insert or extract person(s), article(s), and/or equipment, into or from the water, or onto or from the land, or onto or from rock piles, rock jetties, break walls; insert or extract submarines into or from the water; assist in the efforts of homeland security, military, police and law enforcement, fire-fighting, rescue, and like operations; assist in high speed rescue excursions, including under-fire personnel recovery; assist in turbulent and turbid water rescue, including rescue and recovery from water around dams and waterfalls; assist in aircraft and aircraft personnel recovery; assist in the interdiction of illegal watercraft (smugglers, etc.) and their personnel, contrabands, materials, etc.; assist in buoy and wall servicing at the proper height; and/or provide for the roll on and roll off capabilities of wheelchairs, carts with wheel(s), and specially designed gurneys for rescue operations.

The superior nautical qualities of catamaran type watercraft are well known. Their high beam-to-length ratio and their shallow draft provide desirable stability and resistance to capsizing. In addition, some specialized catamarans offer high speed, extremely smooth ride, enhanced stability, and greater maneuverability due to their hull shape and propulsion location. This combination of improved speed, stability, ride, and maneuverability provides a unique solution to many age-old problems with the current technologies of landing craft (i.e., landing craft are very slow, unstable in comparison, difficult to maneuver, and are wet as a transport platform). Such superior nautical qualities make catamaran watercraft ideally suited for a variety of inland waterway, lake, close to shore, and open ocean tasks. Such tasks include, inter alia, those listed above. For present purposes, "at sea" means any body of water upon which the inventive catamaran can operate, including, inter alia, inland waterway, lake, ocean, sea, or like body of water.

One drawback against other vessel types relates to the superior ability of the catamaran's skipper or crewman to easily accomplish the enumerated tasks. Heretofore, U.S. Pat. No. 5,173,182 proposes an environmental work vessel having a catamaran hull and a pivotally mounted debris scoop mounted between the pontoons. U.S. Pat. No. 3,815,541 proposes a pontoon houseboat having capacity to receive and retain a small craft between the pontoons. In FIGS. 22 and 23, a hinged platform that lowers into the water is disclosed. U.S. Pat. No. 4,020,777 proposes catamaran having a hinged platform between the two pontoons that lowers for retrieving buoys from the water. U.S. Pat. No. 4,545,315 proposes a remote control catamaran type craft with a hinged platform disposed between the pontoons, which platform lowers to retrieve fowl from the water during hunting trips.

Despite such prior proposals, there still exists a need in the art to modify a catamaran or pontoon-type watercraft so that it can easily perform the tasks listed above. It is to such need that the present invention is addressed.

BRIEF SUMMARY OF THE INVENTION

A catamaran has a pair of spaced-apart pontoons, each having a forward flat or curvilinear, tapered end and a rearward end. An underwing is affixed to the pontoons and spans therebetween. The underwing has a forward end and a rearward end. A platform is pivotally connected to the underwing forward end and/or rearward end and conforms to the pontoons at their forward tapered end or their rearward end, respectively. The platform also has a forward end. A power assembly (e.g., oil hydraulic, air hydraulic, cable lift, chain lift, spring loaded, gear-driven, and other lifting mechanism) is connected to the platform for one or more of lowering or raising the platform from a stowed position to a plurality of working positions—including positions below the waterline—of the catamaran and for one or more of raising or lowering the platform back to the stowed position.

The platform forward end can carry a deployable, extendable ramp, which is formed from a pair of spaced-apart floating pontoons with a walkway extending between the floating pontoons.

Further disclosed herein is a watercraft having a hull, a deck, an outer topside system extending upward from the deck along the port and starboard sides of the watercraft, and a fendering system. The fendering system includes a plurality of elastic bladders disposed about one or more of the port outer topside system or the starboard outer topside system. The fendering system also includes lanyards affixed to the elastic bladders, which lanyards permit the bladders to be raised and lowered to protect the watercraft when docking (i.e., next to a pier, wall, other craft(s) or boat(s), etc.), and then to be brought inboard for storage.

BRIEF DESCRIPTION OF THE DRAWINGS

For a fuller understanding of the nature and advantages of the present invention, reference should be had to the following detailed description taken in connection with the accompanying drawings, in which:

FIG. 5 is a sectional view taken along line 5—5 of FIG. 2;

FIG. 6 is an exploded view of a typical hinge assembly shown in FIG. 5—other rotational systems also are applicable;

FIG. 7 is a sectional view taken along line 7—7 of FIG. 2;

FIG. 8 is a side elevational view like that in FIG. 3 with a crewmember of the catamaran standing on the lowered forward underwing for retrieving a person floating in the water;

FIG. 9 is a side elevational view like that in FIG. 3 with the forward hinged underwing resting upon the beach;

FIG. 26 is a side elevational view of an alternative fendering system attachment system for watercraft with thick walls/sides;

FIG. 27 is sectional view taken along line 27—27 of FIG. 26;

FIG. 28 is a perspective view of the part illustrated in FIG. 27 in an uncoupled position; and FIG. 29 is an elevational view of the cam cleat depicted in FIG. 26.

Figure 1:
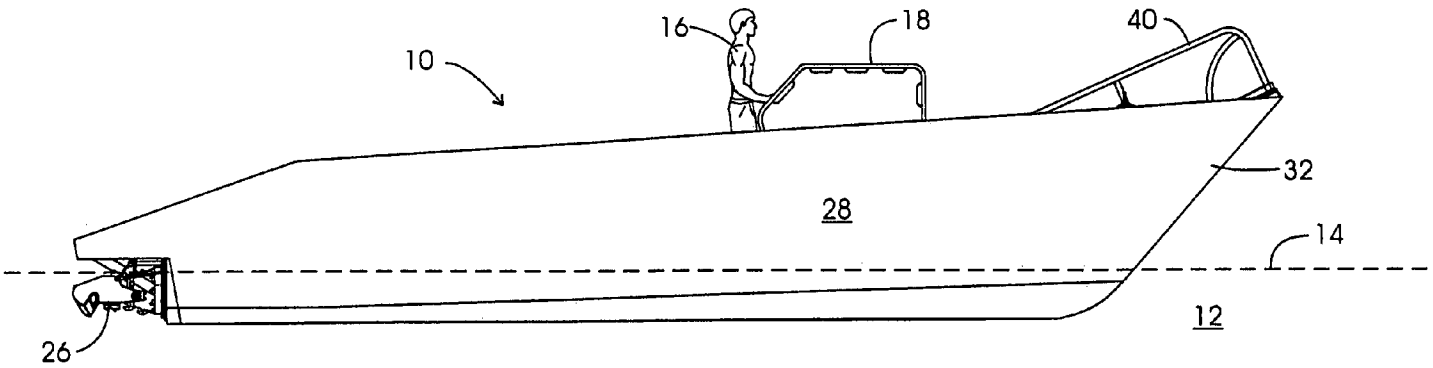
FIG. 1 is a side elevational view of the catamaran floating in a body of water.

The drawings will be described in further detail below.

DETAILED DESCRIPTION OF THE INVENTION

As described above, there is a need to be able to insert or extract person(s), article(s), equipment, into or from the water, or onto or from the land, or onto or from rock piles, rock jetties, break walls; insert or extract submarines into or from the water; assist in the efforts of homeland security, military, police and law enforcement, fire-fighting, rescue, and like operations; assist in high speed rescue excursions, including under-fire personnel recovery; assist in turbulent and turbid water rescue, including rescue and recovery from water around dams and waterfalls; assist in aircraft and aircraft personnel recovery; assist in the interdiction of illegal watercraft (smugglers, etc.) and their personnel, contrabands, materials, etc.; assist in buoy and wall servicing at the proper height; provide for the roll on and roll off capabilities of wheelchairs, carts with wheel(s), and specially designed gurneys for rescue operations which actually allow people in the water to be placed onto a gurney that is then rolled onto the deck, that when upon arrival at the shore or dock, can be rolled to the ambulance. Such "tasks" are well within the capability of the inventive catamaran disclosed herein.

At sea, extraction could involve search, rescue, and recovery missions wherein a watercraft has capsized or otherwise is in distress such that people and/or articles are in the water; turbulent and turbid water rescue and recovery in waters around dams and waterfalls; the interdiction of contraband (articles or people) at sea; as well as high speed rescue, including in under-fire conditions. A variety of other situations similarly could require the watercraft to be able to easily extract person(s), article(s), or equipment from the water or to easily insert divers or swimmers into the water.

On land, quickly inserting and extracting personnel could involve littoral warfare, Special Forces that need to be whisked ashore at a moment's notice, and other conflicts with military implications to fight the ongoing war on terrorism and the battles of the 21$^{st}$ century. It also could involve extracting unwary people who get stranded on rock piles and rock jetties in a rising tide.

With police or law enforcement operations, a notable advantage of this hinged underwing is the ability to provide a work area at the proper height for law enforcement officers while on patrol and while boarding other craft and equipment. During most law enforcement and interdiction operations, the bow of the patrol boat is pointed towards the area of issue, which could be another boat, Jet Ski, buoy servicing, and/or other aids to navigation (e.g., ATON), etc. Often, a common problem on most law enforcement boats is the fact that the bow is too high for the execution of many desired operations. For boarding of other craft and equipment, the bow is often too high for many small boats and jet skies. This movable bow area provides an excellent working platform for many different applications.

Regardless of the motivation, the watercraft of choice often is a catamaran, because of its superior nautical qualities, such as, for example, beam-to-length ratio and shallow draft, which provides desirable stability and resistance to capsizing. In addition, some specialized catamarans also offer high speed, extremely smooth ride, and enhanced maneuverability due to their hull shape. This combination of improved speed, stability, ride, and maneuverability provides a unique solution to many age-old problems with the current technologies of landing craft (i.e., landing craft are very slow, unstable in comparison, difficult to maneuver, and are wet as a transport platform). The catamaran's speed would be important in interdiction efforts, homeland security missions, military operations—including littoral warfare—police and law enforcement patrols, fire-fighting and rescue operations—including high-speed and turbulent water rescue, and other like applications.

Figure 2:
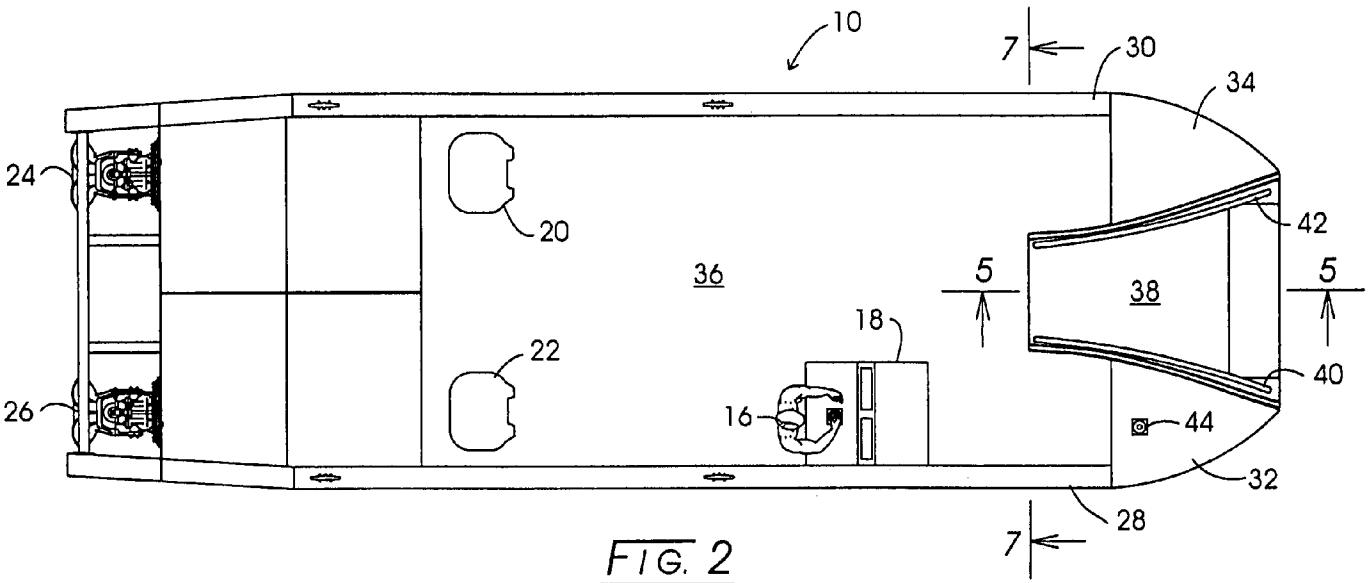
FIG. 2 is an overhead view of the catamaran of FIG. 1.

Referring initially to FIGS. 1 and 2, a catamaran, 10, is seen floating in a body of water, 12, having a waterline, 14. Body of water 12 can be an ocean, lake, river, inland waterway, or any body of water upon which the catamaran can be run. A crewman, 16, stands before a helm, 18. The catamaran as shown has a pair of optional hatches, 20 and 22, and twin water jet assemblies, 24 and 26, powered by engines not shown. Catamaran 10 could be propelled with water jets, conventional underwater gear with propellers, Inboard/Outboards, or Outboards, and other propulsion systems. A cabin or other enclosure also could be provided for catamaran 10, such as, for example, a small medical facility, airlift operations from the deck, etc. Much of the description focuses on the hinged platform extending from the forward end of the underwing. Such hinged platform, however, also can extend from the rear edge of the underwing, or from both the front and rear edges of the underwing, as those skilled in the art will appreciate.

Catamaran 10 includes a pair of pontoons, 28 and 30, (see also FIG. 7) each have a forward tapered section, 32 and 34, respectively, as is typical in catamaran design. Interconnecting pontoons 28 and 30 is an underwing (bridgework) or deck, 36. Hatches 20 and 22, crewman 16, and helm 18, all rest atop deck 36. Additional lifesaving gear, anchor, line, and the like, are carried aboard catamaran 10 in conventional fashion, and as needed depending upon its mission, marine regulations, type of water upon which it operates (e.g., salt water, brackish water, or fresh water), and the like. The size of catamaran 10 also fits its mission, marine regulations, type of water upon which it operates, and like factors well known to the skilled seaman.

Figure 3:
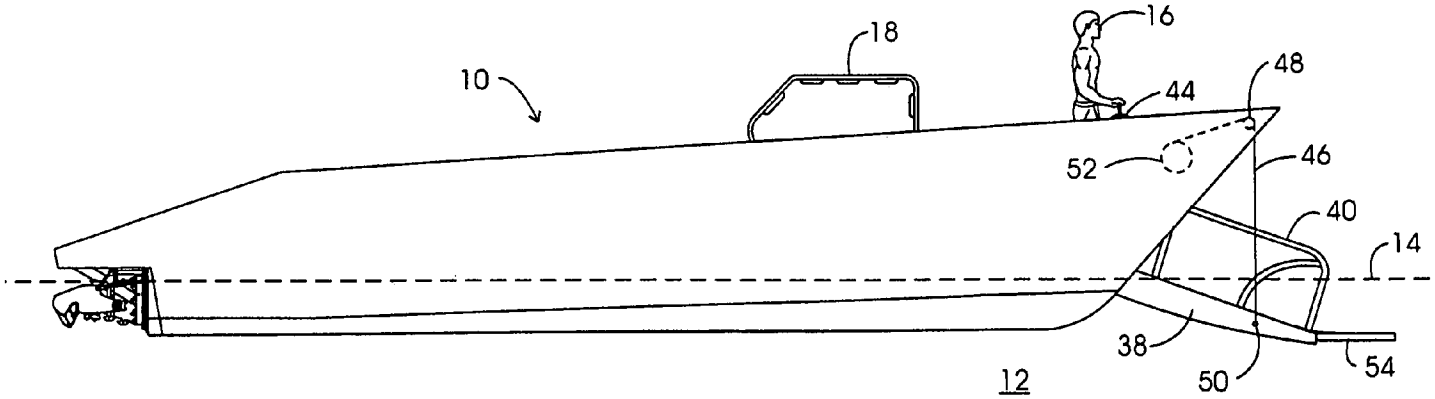
FIG. 3 is a side-elevational view of the catamaran of FIG. 1 with the forward portion of the underwing lowered into the water, for example, to insert or extract person(s), article(s), or equipment into or from the water; or to roll down a retrieval gurney for an unconscious or otherwise disabled person.
Figure 4:
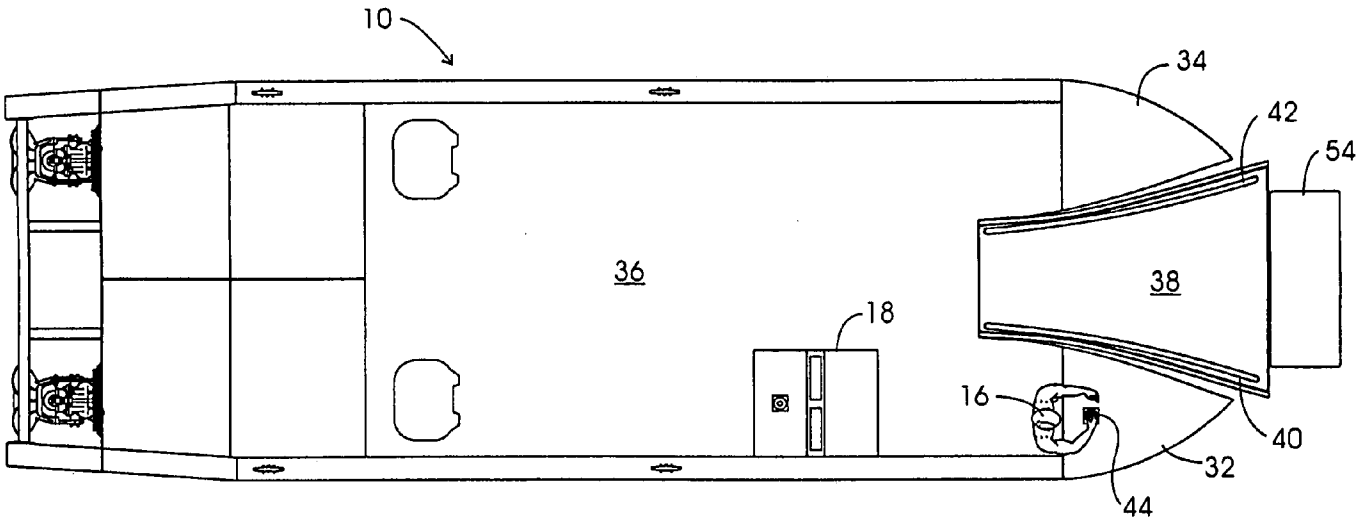
FIG. 4 is an overhead view of the catamaran of FIG. 3.
Figure 10:
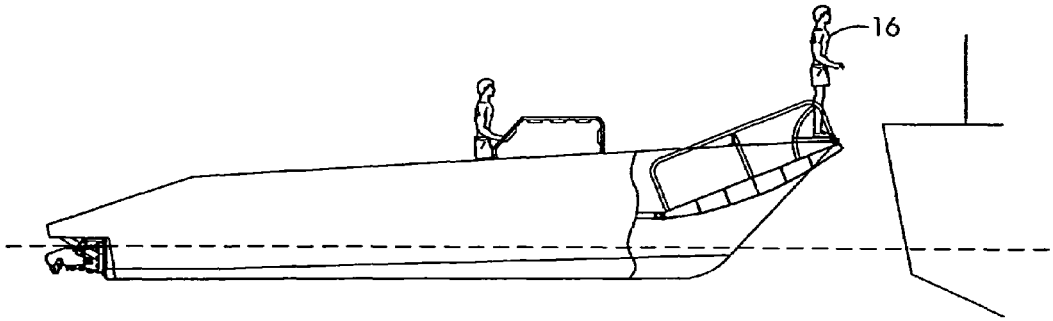
FIGS. 10 through 14 are side elevational views, like those in FIGS. 8 and 9, with the adjustable platform or ramp at different appropriate heights for different missions and the adjustable platform extension at appropriate heights and level for standing upon for a specific mission.
Figure 11:
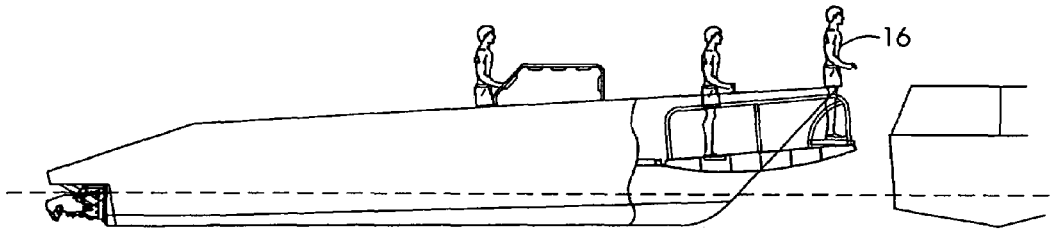
Figure 12:
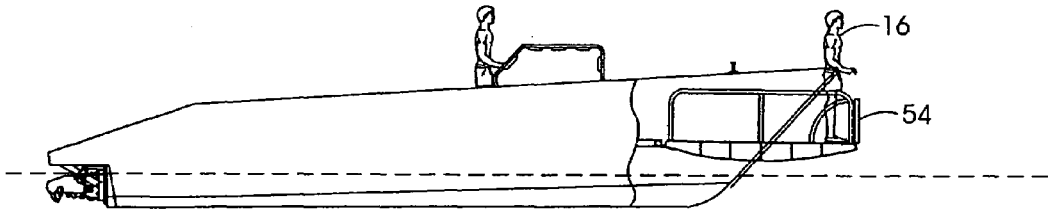
Figure 13:
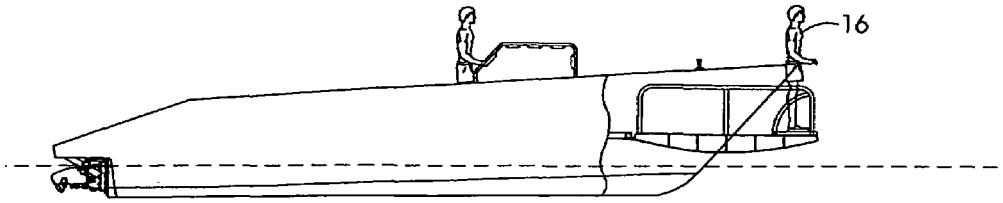
Figure 14:
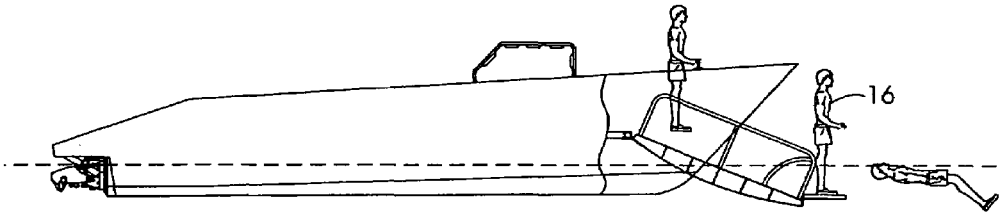

In order to provide a rescue capability, a platform, 38, is hingedly or pivotally connected to the forward edge of underwing 36. Railings, 40 and 42, extend adjacent to hinged platform 38 for safety. Referring now also to FIGS. 3 and 4, crewman 16 has moved forward to a control, 44, in order to control and operate the catamaran with full visibility of people and equipment in the water and to control the elevation of platform 38. In addition, lights can be installed, night vision equipment, etc., for night or inclement weather extraction and insertion operations. While a variety of mechanisms for raising and lowering platform 38 can be envisioned and utilized (e.g., oil hydraulic, air hydraulic, cable lift, chain lift, spring loaded, gear-driven, and other lifting mechanisms), a simple line (for example, steel or other suitable cable) and pulley system is illustrated in the drawings. Specifically, a line, 46, surmounts a pulley, 48, and is connected to platform 38 at a connection point, 50, and to a motor assembly, 52, which includes a reel for line 46 to be wound about. The skilled artisan will appreciate that other power sources capable of lowering and raising platform 38 with line 46 can be used, including a hand crank, as is necessary, desirable, or convenient.

Platform 38 also can retain an extension, 54, at its forward end, which extension can unfold or otherwise extend from platform 38 into and, perhaps, slightly under waterline 14 to aid in the ability of crewman 16 to walk onto extension 54 to insert or extract person(s), article(s), or equipment into or from the water. Platform 38 also will be seen to flare out at its forward end to follow the contour of forward tapered sections 32 and 34. Such shape results in a larger working area for platform 38 which can be especially useful when platform 38 is lowered into a working or rescue position.

Referring now to FIGS. 5, 6, and 7, platform 38 will be seen in an upward or stowed position and in phantom in a lowered position, such as for extracting person(s), article(s), or equipment from the water, or inserting divers or swimmers into the water. A portion of platform 38 and extension 54 are slightly under waterline 14 in FIG. 5, although this is not necessary. While a variety of hinge systems can be envisioned, a simple hinge system is shown in FIG. 6. Specifically, a hinge assembly, 56, pivotally connects underwing 36 to platform 38. Extension 54 also is folded back onto platform 38 in a stowed position. Extension 54 also desirably is hingedly connected to platform 38 and is capable of being unfolded by crewman 16 to an operating condition.

FIG. 8 illustrates novel catamaran 10 rescuing a person, 58, from the water. Specifically, platform 38 has been lowered, extension 54 unfolded, and crewman 16 has walked down onto extension 54 to reach person 58. The ability of platform 38 and especially extension 54 to reach below waterline 14 enables crewman 16 to more easily reach person 58. Such design may even permit a single crewman to affect a rescue at sea.

FIG. 9 illustrates another anticipated use for novel catamaran 10. Crewman 16 has driven catamaran 10 to a beach, 60, which can be directly accessed with lowered platform 38. Extension 54 still is in its folded and stowed position, but may be extended, if needed. Regardless, the design of pivoting platform 38 enables catamaran 10 to land crewman 16 onto shore 60 for extracting person(s), article(s), or equipment, or to unload people or cargo, or for any other use desired.

FIGS. 10 through 14 depict crewman 16 standing at various elevations on adjustable platform extension 54 at appropriate heights and level for standing for a specific mission. Also note FIG. 12 where extension 54 is elevated at 90 degrees to the horizon for providing a stop for approaching boats and protection for crewman 16.

Figure 15:
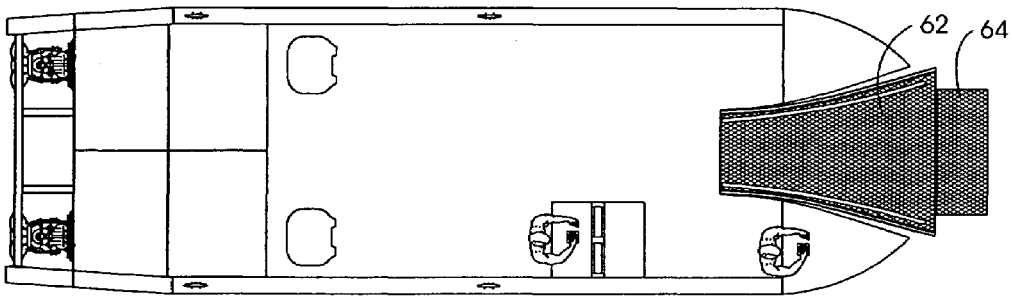
FIG. 15 is an overhead view like that in FIG. 2 with a specially louvered or grated platform and extension for allowing water to pass therethrough.

FIG. 15 shows a specially designed platform 62 and extension 64 with special louvered holes (apertures) allowing water passing through without adversely affecting the maneuverability of catamaran 10. This provides for slow operation with the platform 38 fully lowered and the boat in forward motion. Platform 62 and extension 64 are variants of platform 38 and extension 54. Platform 62 and extension 64 are of grated construction to allow passage of water through its structure while the vessel is in motion, consequently expanding its abilities and uses beyond that of platform 38. Examples of platform 62 and extension 64's abilities over that of platform 38 and extension 54 would be insertion or extraction of people, article(s), or equipment onto or from rock piles, rock jetties, and break walls; as well as turbulent or turbid rescue and recovery missions, including those around dams and waterfalls. What makes platform 62 able to do this and not platform 38 is because the grated construction allows water to pass through rather than over and into the boat; this "passing through of water" prevents flooding and submergence of the boat into turbulent waters; it also affects handling and maneuverability.

Another example of platform 62 and extension 64's unique abilities over platform 38 and extension 54 is high speed rescue, including in under-fire conditions; the high speed is achieved because of reduced water drag and water flow over the platform 62 and extension 64 compared with platform 38 and extension 54. Of course, other construction of platforms 38/62 and extensions 54/64 are possible, as those skilled in the art will appreciate.

Figure 16:
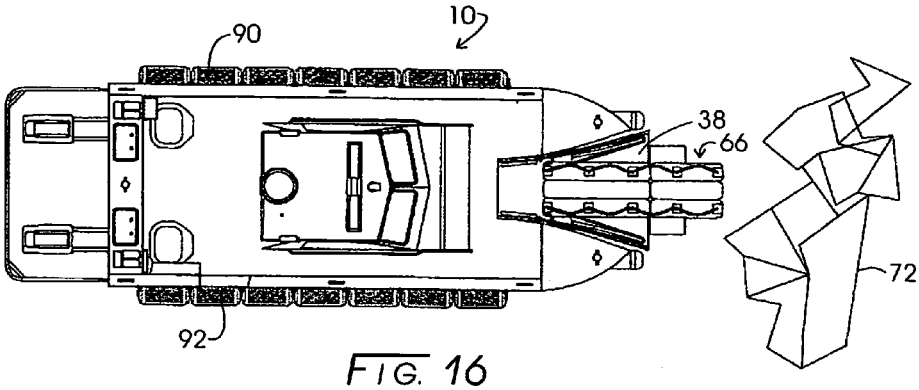
FIG. 16 is an overhead view of a catamaran having the extending platform that has been fitted with a deployable extending ramp that is shown in the storage mode, the catamaran also having the novel fendering system adapted about it.
Figure 17:
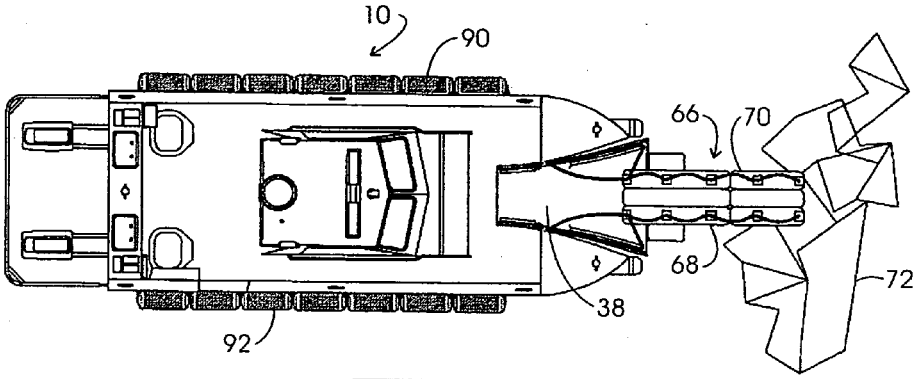
FIG. 17 is an overhead view of the catamaran of FIG. 16, with the extending deployable ramp extended to a rock formation for ingress and egress of personnel thereto and therefrom.
Figure 18:
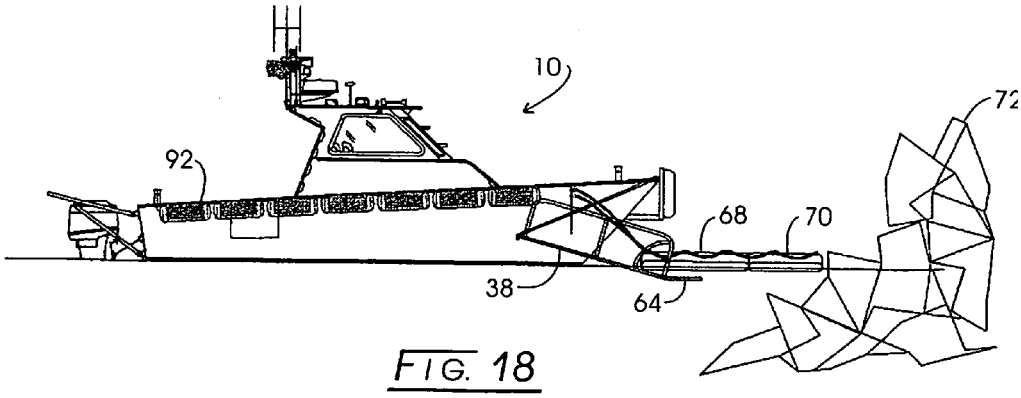
FIG. 18 is a side elevational view of the catamaran of FIG. 17.

Rescues and transfer of goods in rough seas, for example, risks damage to platform 62 and to extension 64, when the craft is near anything hazardous, such as, for example, rock piles, wooden timbers, and the like. FIGS. 16–18, then, depict one feature that catamaran 10 can be outfitted with in order to reduce the opportunity for catamaran 10, platform 62, and/or extension 64 becoming damaged. Such damage avoidance and/or minimization can be accomplished by affixing a deployable ramp, 66 to platform 62. Deployable ramp 66 can be formed from one or more modules, 68 and 70, being shown for illustration only, as one or a multiplicity/plurality of modules can be provided. Deployable ramp 66 can protect catamaran 10, platform 62, and/or extension 64 from becoming damaged, for example, against a rock pile, 72.

Figure 19:
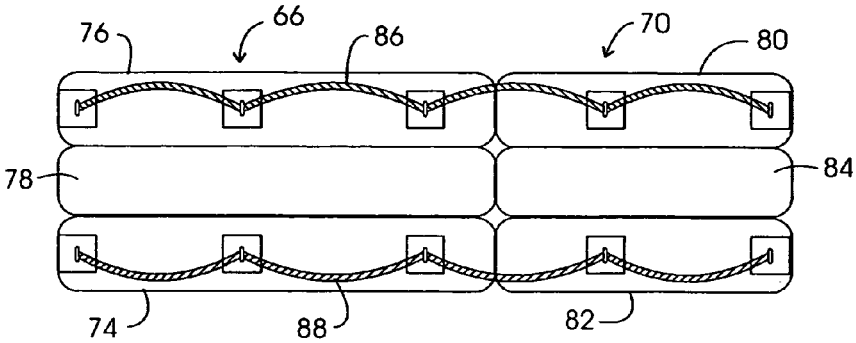
FIG. 19 is an exploded overhead view of the extending ramp in the extended active mode and formed from a pair of ramp modules.
Figure 20:
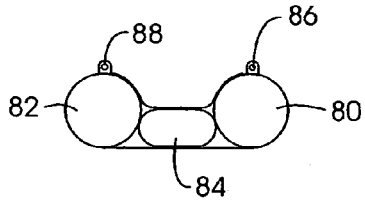
FIG. 20 is a front view of the platform/ramp combination of FIG. 19.
Figure 21:
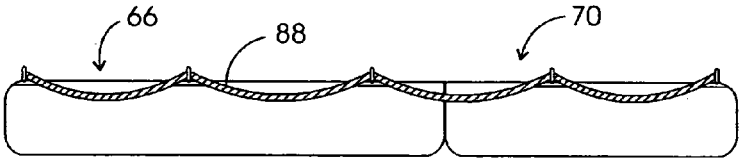
FIG. 21 is a side elevational view of the platform/ramp combination of FIG. 19.

Referring to FIGS. 19 and 20, deployable ramp module 68 is formed from a pair of spaced apart floatable pontoons, 74 and 76, with a foot ramp, 78, extending therebetween. Deployable ramp module 70 is formed from a pair of spaced apart floatable pontoons, 80 and 82, with a foot ramp, 84, extending therebetween. The pontoons can simply be inflatable bladders manufactured from plastic (e.g., HYPALON® brand chlorosulfonated polyethylene, DuPont Dow Elastomers L.L.C., Wilmington, Del.), which plastic advantageously will be elastomeric. Alternatively, closed cell elastomers or other floatable elastomeric or rubbery materials can be used. The foot ramps will need to be more rigid to support the weight of personnel, supplies, and the like. Thus, the ramps advantageously will be made from wood, fiberglass, metal, pressurized air bladders, or the like. Should either or both of modules 68 or 70 become damaged in action, they can be removed for repair and/or replacement. Importantly, the integrity of catamaran 10 has been preserved, along with that of platform 38 and extension 64.

Also, the port side of catamaran 10 is protected when catamaran 10 is docked or otherwise alongside an object by a novel fendering system, 90, while the starboard side of catamaran 10 is protected a novel fendering system, 92. Each fendering system 90 and 92 is formed from a series of elastomeric bumpers, which may be air filled bladders, open/closed cell elastomeric foam, semi-rigid elastomer annulus, or the like. Conventionally, such bumpers are elongate cylinders in external shape, which can be oriented horizontally or vertically. It is common for watercraft to have such bumpers for protecting the craft during docking next to a pier, wall, other craft(s), or boat(s), etc. Novel fendering systems 90 and 92 employ conventional and unconventional such bumpers.

Figure 22:
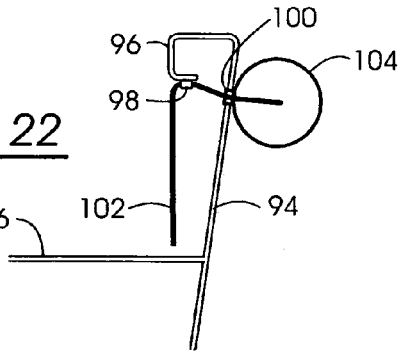
FIG. 22 is a side elevational view of the fendering system with a horizontal fender pontoon in the stowed position.
Figure 23:
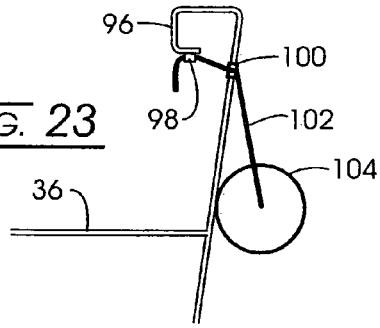
FIG. 23 is a side elevational view of the fendering system with the horizontal fender pontoon in the active, extended position.

Fendering systems 90 and 92 are illustrated in detail in FIGS. 22–25. In particular, FIG. 22 shows an outer topside, 94, affixed to deck 36 or to structure associated with deck 36. Outer topside 94 is bent inwards at its top to form an outward "C", 96. Attached to "C" 96 is a cam cleat, 98. Attached to outer topside 96 approximately across from cam cleat 98 is a grommet, 100, also known as a fairlead, which also could be made of multiple materials including, for example, nylon, Delron, many other plastics, stainless steel, steel, bronze, and other materials. Now, a lanyard, 102, lashes a bumper, 102 (104), to outer topside 94 by running through cam cleat 98 and grommet 100. Lanyard 102 can be secured directly to outer topside 94. By letting out or pulling in on lanyard 102, the crew can lower or raise bumper 104 to any given position to correspond with the expected contact point of the dock, ship, or other object which catamaran 10 pulls along side or which pulls along side catamaran 10 for protecting the craft. Each of the myriad of bumpers that form fendering systems 90 and 92 are constructed in such a manner. The skilled artisan will appreciate that a single lanyard can control more than one bumper. Also, the bumpers may be joined together in groups of two or more, not joined at all, or combinations, in forming fendering systems 90 and 92.

Figure 24:
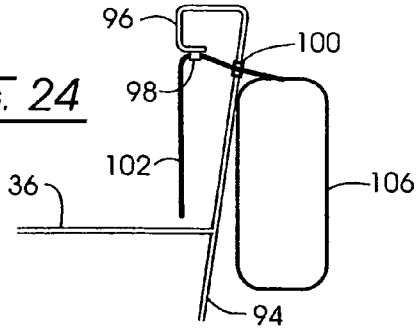
FIG. 24 is a side elevational view of the fendering system with a vertical fender pontoon in the stowed position.
Figure 25:
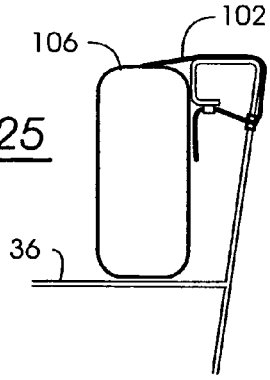
FIG. 25 is a side elevational view of the fendering system with the vertical horizontal fender pontoon in the active, extended position.

FIGS. 24 and 25 illustrate a vertically oriented bumper, 106, secured by lanyard 102. These drawings also illustrate the ability to bring bumper 106 on board catamaran 10 for storage. Of course, the skilled artisan will appreciate that the novel fendering system will function efficaciously on crafts other than catamarans. Thus, the description of the fendering system with specific reference to a catamaran is for illustration purposes and not by way of a limitation on this aspect of the invention. The same is true for cam cleat 98 and grommet 100, as the skilled artisan will appreciate that other grommet constructions and locations are viable for fendering systems 90 and 92. Obviously the use of a cam cleat and nylon or similar materials facilitates the movement of the bumpers and friction on the lanyard, which will be constructed of sea worthy materials.

FIG. 26 illustrates the novel fendering system for watercraft having a thick wall or outer topside 108, at the juncture where the lanyard, 110, is required to pass through outer topside 108. Outer topside 108 is illustrated as being formed from an outer skin, 112, typically formed from a sea-worthy metal have an inner core, 114, which may be an insulation material or the like. Nevertheless, lanyard 110 needs to penetrate through the entire thickness of outer topside 108. This lanyard penetration can be accomplished by a variety of techniques. That technique illustrated in FIG. 26 includes an extendable or telescoping tube, 116, which fits within an aperture formed in outer topside 108. Tube 116 desirably is extendable to accommodate walls/railings of varying thicknesses. While the skilled artisan can envision a variety of techniques to making tube 116 extendable, FIGS. 27 and 28 shows tube 116 formed from a pair interfitting tube sections, 118 and 120, which are hollow with tube section 118 being internally threaded at one end while tube section 120 is externally threaded at one end. The threaded ends of tube sections 118 and 120 screw together. By inserting the tube sections in either end of the aperture formed in outer topside 108, tube sections 118 and 120 are screwed together to form a passageway through outertopside 108 to accommodate lanyard 110.

Lanyard 110, then, is used with the mounting system, 122, depicted generally in FIG. 26 and in detail in FIG. 29. Again, a variety of mounting systems can be envisioned by the skilled artisan. FIG. 29, for example, shows a mounting plate, 124, attached to the inside wall, 126, of outer topside 108. A pair of cam cleats, 128 and 130, which have mutually engaging teeth, bite into lanyard 110 and keep lanyard 110 in a desired fixed position.

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Also, all citations referred herein are expressly incorporated herein by reference.

I claim:

1. A catamaran, which comprises:

(a) a pair of spaced-apart pontoons, each having a forward tapered end and a rearward end;

(b) an underwing affixed to said pontoons and spanning therebetween, said underwing having a forward end and a rearward end;

(c) a platform pivotally connected to one or more of said underwing forward end or said underwing rearward end;

(d) a deployable extension ramp carried by said platform forward end and formed from a pair of spaced-apart floating pontoons with a walkway extending between the floating pontoons;

(e) an extension movable from a stowed position to an extended position and being pivotally connected to said platform forward end, wherein said extension is under water when extended and said platform lowered; and (f) a power assembly connected to said platform for one or more of moving said platform from a stowed position to a plurality of working positions, and for retracting said platform back to said stowed position.

2. The catamaran of claim 1, wherein said platform carries railings.

3. The catamaran of claim 1, wherein one or more of said platform or said extension is louvered.

4. The catamaran of claim 1, wherein said extension is movable to a position about 90° from the horizontal and adjustable to keep level for a crew to stand on.

5. The catamaran of claim 1, wherein said platform is pivotally connected to said underwing forward end.

6. The catamaran of claim 1, wherein said deployable ramp is formed from one or more ramp modules.

7. A method for one or more of insertion or extraction of one or more of people, articles, or equipment at sea, which comprises:

(a) providing a catamaran, which comprises:

(i) a pair of spaced-apart pontoons, each having a forward tapered end and a rearward end;

(ii) an underwing affixed to said pontoons and spanning therebetween, said underwing having a forward end and a rearward end;

(iii) a platform pivotally connected to one or more of said underwing forward end or said underwing rearward end;

(iv) an extension carried by said platform and movable from a stowed position to an extended position operable to aid in accessing one or more of insertion or extraction, wherein said extension is under water when extended and said platform lowered:

(v) a deployable extension ramp carried by said platform forward end and formed from a pair of spaced-apart floating pontoons with a walkway extending between the floating pontoons; and (vi) a power assembly connected to said platform for one or more of lowering or raising said platform from a stowed position to a plurality of working positions and for one or more of raising or lowering said platform back to said stowed position;

(b) moving said platform to a position in the vicinity of said one or more people, articles, or equipment;

(c) moving said deployable extension ramp to a position adjacent to said one or more people, articles, or equipment; and (d) a crewperson accessing said platform and said deployable extension ramp to accomplish said one or more of insertion or extraction.

8. The method of claim 7, wherein said one or more of insertion or extraction of one or more of people, articles, or equipment at sea, comprises one or more of into or from the water, or onto or from the land, or onto or from rock piles, rock jetties, or break walls; insertion or extraction of submarines into or from the water; assisting in the efforts of homeland security, military, police and law enforcement, fire-fighting, or rescue operations; assist in high speed rescue excursions or under-fire personnel recovery; assist in turbulent and turbid water rescue; assist in aircraft and aircraft personnel recovery; assist in the interdiction of illegal watercraft and their personnel, contrabands, or materials; assist in buoy and wall servicing at the proper height; provide for the roll on and roll off capabilities of wheelchairs, carts with wheels, and rescue operation designed gurneys.

9. The method of claim 7, wherein said extension is pivotally connected to said platform at its forward end.

10. The method of claim 9, wherein said extension is movable to a position about 90° from the horizontal and adjustable to keep level for the crew to stand on.

11. The method of claim 7, wherein one or more of said platform or said extension is louvered.

12. The method of claim 7, wherein platform is pivotally connected to said underwing forward end.

13. The method of claim 7, wherein said deployable ramp is formed from one or more ramp modules.

14. In a watercraft having a hull, a deck, an outer topside system extending upward from said deck along the port and starboard sides of said watercraft, a fendering system which comprises:

(a) a plurality of elastic bladders disposed about one or more of the port outer topside system or the starboard topside system; and (b) lanyards affixed to said elastic bladders, which lanyards permit said bladders to be raised and lowered to protect said watercraft when docking, and to be brought inboard for storage, wherein said lanyard runs through an extendable tube that extends through one or more of said watercraft hull or said outer topside.

15. The fendering system of claim 14, wherein said bladders contain air.

16. The fendering system of claim 14, wherein said bladders are formed from elastomeric material.

17. The fendering system of claim 14, wherein said lanyard runs through a grommet affixed to said topside system.

18. The fendering system of claim 14, wherein said bladders are disposed one or more of horizontally or vertically.

19. The fendering system of claim 14, wherein said bladders are disposed horizontally and said lanyard secures both ends of said bladders.

* * * * *